United States Patent [19]

Fischlin

[11] 4,166,643

[45] Sep. 4, 1979

[54] TRAIN OF CARBON COPY DUPLICATING FORM SETS FOR USE IN OFFICE MACHINES

[76] Inventor: Jürg E. Fischlin, Rebweg 3, Erlenbach, Switzerland

[21] Appl. No.: 863,701

[22] Filed: Dec. 23, 1977

Related U.S. Application Data

[63] Continuation of Ser. No. 616,268, Sep. 24, 1975, abandoned.

[30] Foreign Application Priority Data

Sep. 24, 1974 [CH] Switzerland ..... 12894/74
Oct. 31, 1974 [CH] Switzerland ..... 14585/74

[51] Int. Cl.[2] ..... B41L 1/32
[52] U.S. Cl. ..... 282/11.5 A
[58] Field of Search ..... 282/11.5 R, 11.5 A, 282/12 A, 13, 14, 15 R, 15 A, 15 B, 21 R, 21 A, 22 R

[56] References Cited

U.S. PATENT DOCUMENTS

| | | | |
|---|---|---|---|
| 2,172,870 | 9/1939 | Fulk | 282/11.5 R |
| 2,319,165 | 5/1943 | Sornberger | 282/11.5 A |
| 2,931,666 | 4/1960 | Burgmer | 282/11.5 A |

FOREIGN PATENT DOCUMENTS

| | | | |
|---|---|---|---|
| 1172282 | 6/1964 | Fed. Rep. of Germany | 282/11.5 A |

*Primary Examiner*—Travis S. McGehee
*Attorney, Agent, or Firm*—McGlew and Tuttle

[57] ABSTRACT

A train of carbon copy duplicating form sets for use in office machines, comprises a plurality of sets of vertical stacks of sheets. At least some of the sheets comprise sheets having imprinted forms thereon. Carbon transfer means are associated with at least some of said sheets for transferring typed information from one sheet to the other. The sheets are arranged in a vertical stack, and at least one has a trailing end with a severable trailing head marginal portion which extends across the width of the sheet and is demarcated from the remainder of the sheet by a first weakened line which extends across the sheet. A second weakened line extends across the sheet at the opposite end, and a portion extends from the opposite end of the sheet forwardly into a position at which it overlies at least one of the sheets of the next adjacent set and is, for example, secured to this sheet by adhesive or other means. In one embodiment, the lowermost sheet of one set has a forward head portion which extends forwardly of the lowermost sheet and is demarcated from this sheet by the second weakened line. This forward head portion is folded upwardly and then rearwardly and upon iself so that, the last folded portion is secured to the head of the uppermost sheet of the next adjacent set. The lowermost sheet advantageously also includes side marginal portions which are wider than some of the other sheets and which are provided with perforations for facilitating their feed or interengagement. Instead of the sets being interconnected by sheets which are folded upwardly from the lowermost sheet to overlay the top sheet of the trailing head portion of the next adjacent set, the interconnection may be made between all of the lowermost sheets and, additionally, by forming an uppermost sheet of each set with a portion extending outwardly on the normal sheet end and beyond a weakened line thereacross which is folded to overlay the trailing head portion of the uppermost sheet of the next adjacent set. Various other arrangements are possible for effecting the interconnection and the easy demarcation and separation of the sheets and sets.

4 Claims, 8 Drawing Figures

TRAIN OF CARBON COPY DUPLICATING FORM SETS FOR USE IN OFFICE MACHINES

This is a continuation, of application Ser. No. 616,268 filed Sept. 24, 1975, now abandoned.

FIELD AND BACKGROUND OF THE INVENTION

This invention relates in general to the construction of forms for use in typing and, in particular, to a new and useful train of carbon copy duplicating form sets for use in office machines.

DESCRIPTION OF THE PRIOR ART

The present invention deals with the construction of forms of a type which are fed continuously into an office machine, such as a typewriter, in the form of a train. Trains of carbon copy duplicating form sets for use in office machines which are separably connected to one another in a continuous train are known which comprise a special guide web to which the individual form sets are glued by their head strips formed at the head portions of the form sheets. As soon as a set is detached from the guide web, each individual form can be separated from its head portion along a perforated line. The guide web comprises the usual marginal feed perforations and, in most instances, is made of a strong paper. Between the consecutive form sets, there is a folding line so that the form sets can be superposed in aligned equidirectional positions. These known trains of form sets have a substantial disadvantage, not only in respect to the fact that they require relatively expensive additional guide webs, but also because the guide webs must be relatively thick and thus occupy a large space which tends to increase the height of the form sheets to a degree in which they are not easily maneuverable, or easy to pass through the office machines without reducing the form sets to a much smaller number than would be desired.

SUMMARY OF THE INVENTION

In accordance with the present invention, there is provided a train of carbon copy duplicating form sets in which at least one of the stack of sheets of each set is provided with an extension beyond a weakened line which is folded so as to overlie a portion of one of the sheets of the next adjacent set. The overlying portion is preferably oriented to become superposed over the head portion of each form sheet which comprises a marginal portion adjacent the trailing end which is demarcated from the remainder of the sheet by a weakened line or separation line, such as a perforation. The overlapping portion of the sheet from the next adjacent stack is advantageously glued over the head portion and it is made coextensive with the area of the head portion.

A particularly advantageous construction of the form sets includes one in which the form sets are connected directly together by their lowermost form seets and they are made separable from each other along a weakened line. In such a construction, at least one further form sheet of each set overlaps the head portion of the uppermost form of the adjacent set. Due to this construction, the lowermost form sheets of all of the sets form a continuous web connecting the sets to a train. The lowermost forms may form an integral web or they may constitute the individual sheets which are connected to each other, for example, by gluing. In any case, however, they are usable as forms and it is not necessary to dispose of them after the sets have been separated. It is also possible to provide the lowermost forms of all of the sets as a continuous, integral web to which the other forms of each set are, for example, glued. Alternately, the lowermost forms may be made longer relative to the other forms of each set and secured, for example, by gluing to the head portion of the lowermost form of the trailing set so that, in this case, the lowermost forms of all of the sets form a continuous web made up of individual form sheets.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figures 1, 1A, 2:
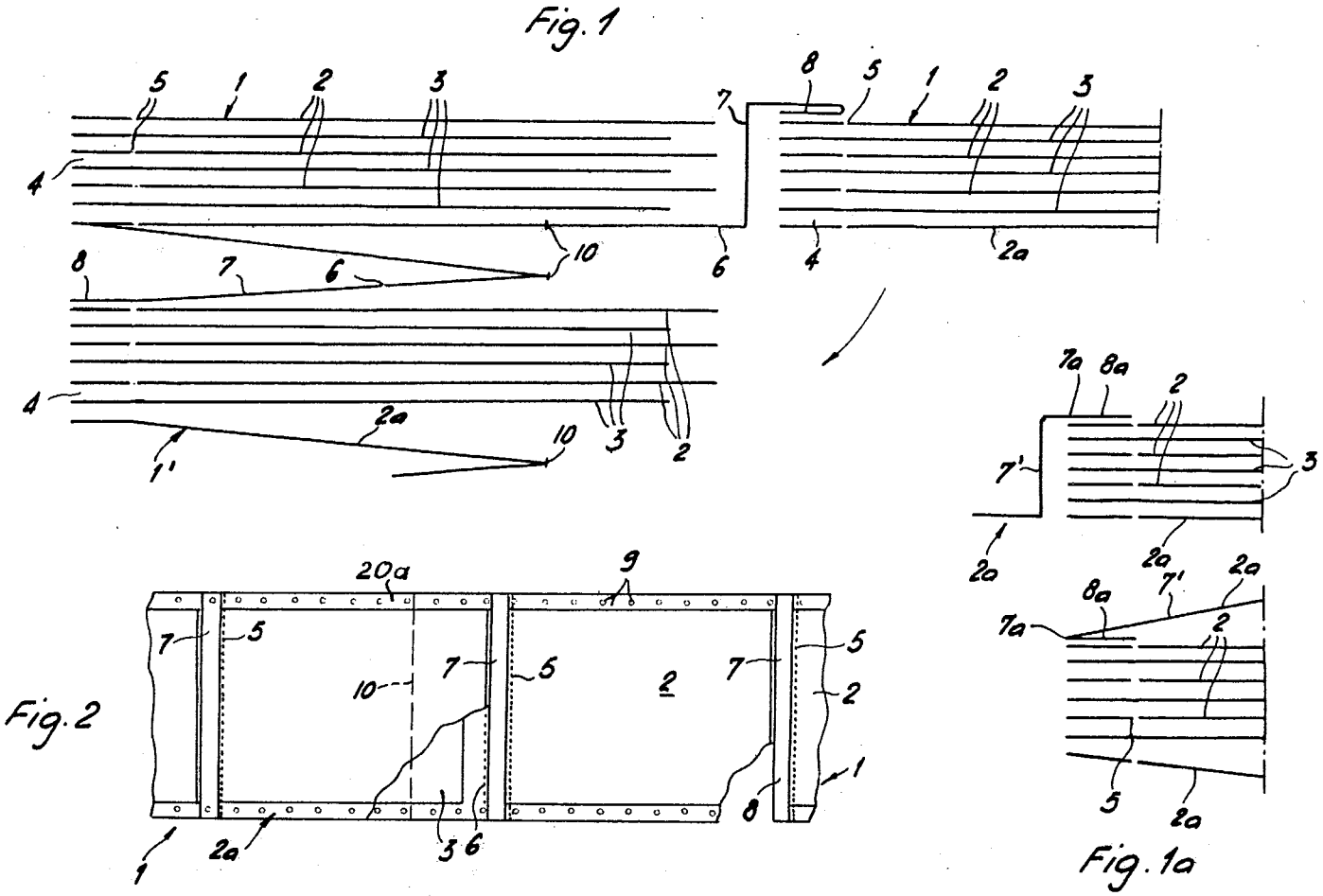
FIG. 1 is a longitudinal sectional view of a train of duplicating form sets showing both a sequential and a superposed position of the form sets.
FIG. 1*a* is a partial view similar to FIG. 1 of another embodiment of the invention.
FIG. 2 is a top plan view of the form sets shown in FIG. 1.

Referring to the drawings in particular, the invention embodied therein, comprises a train of form sets which comprise individual sets formed into vertical stacks 1, comprising a plurality of rectangular sheets 2, 2 and with a lowermost sheet 2*a*. Carbon papers or other reproducing means 3 are inserted between the sheets. Each sheet includes a trailing head portion or head strip 4 which extends over a complete marginal area adjacent the trailing edge of each sheet and is demarcated therefrom by a score or weak line 5 which may, for example, be a perforation. Carbon papers 3 do not have to be provided with a weak line.

The lowermost sheet 2*a* of each set is made longer than the others and it includes a forward portion 7 which extends beyond a second weak line or separation line 6 which aligns with the edges of the sheets which are piled on top of the lowermost sheet.

The forward strip portion 7 is folded up in front of the head strip 4 and includes a portion 8 folded upon itself which is adapted to overlap head strip 4 of the next adjacent set 1' and be secured thereto, such as by gluing. In this manner, all of the form sets are satifactorily interconnected to one another and can be introduced into an office machine without any difficulty. In the illustrated embodiment of FIGS. 1 and 2, lowermost sheet 2a of each form set is provided with laterally projecting feed margins 20a having perforations 9.

In order to form a pile or stack in which the individual form sets must be superposed equidirectionally, the lowermost sheet 2a of each set is provided with a transversely extending fold line 10 about which during the piling up of the form sets 1, 1' into a vertical stack, so that the set 1' is moved in the direction of the arrow below set 1, sheet 2a must be folded about fold line 10.

It is also possible to glue the free edge strip of the forwardly extending portion 7 of the lowermost sheet 2a directly, and without folding, to the head portion of the uppermost sheet 2 of the preceding or trailing set, as shown at 8a in FIG. 1a. In this embodiment, the forwardly extending portion 7' is provided in the zone of the upper edge of head strip 4 with a fold line 7a about which the forwardly extending portion 7' is folded forwardly during the piling of the form sheets, as indicated in the lower portion of this figure. The embodiment is such that a good feed will be effected even if the drive mechanism feeds in a disconnected or jerky manner and the risk of an undesirable tearing away of one set from the other is reduced.

Figure 3:
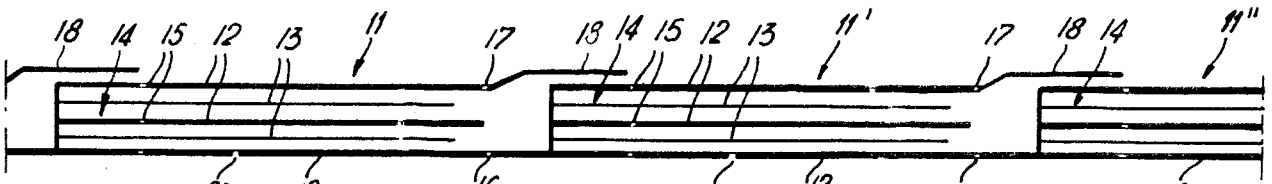
FIG. 3 is a longitudinal sectional view of a train of form sets having an integral bottom form web of another embodiment of the invention.

In the embodiment of FIG. 3, the individual form sets 11, 11' and 11" are connected to a continuous train, each of which comprises sheets 12, 12 and a lowermost sheet 12a with carbon papers 13 inserted between the sheets. Instead of providing a carbon paper 13, any reproducing means, such as a coating or treatment of the underside of each of the sheets 12 can also be provided, if desired.

Each sheet 12, 12a and the carbon sheet 13 are united to a head strip portion 14 which is formed adjacent one end, for example, the trailing end of the associated sheet be a demarcation line or weakened area 15 which separates the head strip 14 from the remainder of the sheet. In this embodiment, the lowermost form sheets 12a extend continuously into each of the sets 11, 11', 11", etc. This sheet 12a is provided with transversely extending weakened lines or separation lines 16 which are aligned with the bottom edges of the other sheets 12. The form sets may be separated from each other by tearing along these weak lines 16.

In the specific examples of FIG. 3, the uppermost form sheet 12 of each form set has a portion which extends forwardly beyond a weak line 17 and it terminates in an overlapping portion 18 which is adapted to be secured to the head strip 14 of the next adjacent set 11'. During the passage of the train of the form sets through a writing office machine, an abutting of the free edge of the head strip 14 will be prevented by this construction so that there is less tendency for there to be any disturbances in the feed or tearing apart of the form sets. The weakened line 17 could also be omitted in cases where a correspondingly longer form sheet would be suitable.

Figure 7:
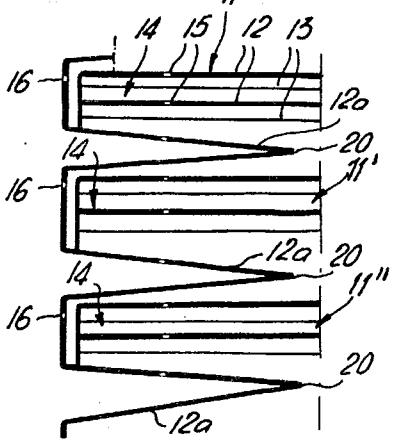
FIG. 7 is a view similar to FIG. 3 showing the sets in a stacked position.

In order to form a pile, as indicated in FIG. 7, in which the form sets 11 are superposed one over the other, the lowermost form sheet 12a of each set 11 is provided with a transversely extending fold line 20 about which each sheet 12a is foldable during the piling of the form sets 11, 11', 11", etc. into a vertical stack.

Figure 4:
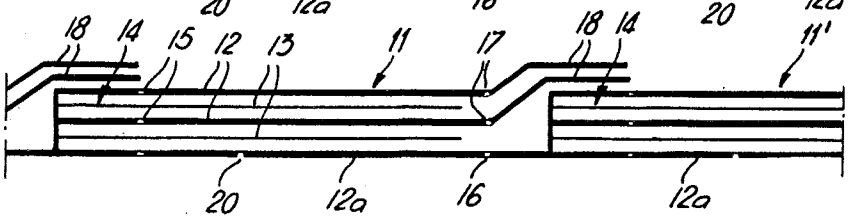
FIG. 4 is a view similar to FIG. 3 of another embodiment of the invention.

In the embodiment shown in FIG. 4, the sheets are designated similar to that of FIG. 3, and the uppermost few of the form sheets 12 are each provided with forwardly extending excess portion 18 which overlaps the head strip portion 14 of the next adjacent set. It would also be possible to provide more than two sheets 12 with a corresponding portion in excess.

Figure 5:
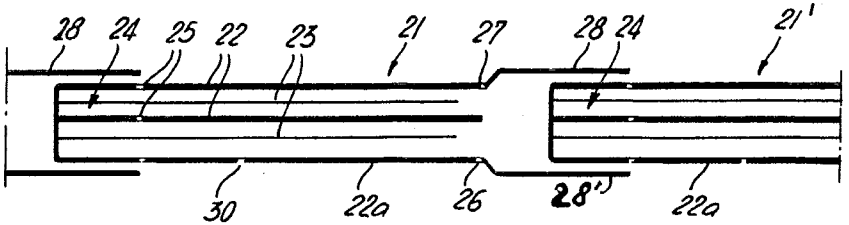
FIG. 5 is a view similar to FIG. 3 of still another embodiment of the invention.

In the embodiment of FIG. 5, the lowermost form sheets 22a of each form set are individually extended beyond a weakened line 26 and this extended portion 28' overlaps the head portion of the lowermost form sheet 22a of the next set 21 and is secured, for example, by gluing to the head portion thereof. Due to the interconnection of the lowrmost form sheets 22a by the single web, all of the form sets 21 are connected to one another at the same time. Each of the sets includes sheets 22 and a bottom sheet 22a with carbon papers or copying means 23 interposed therebetween. The lowermost form sheet 22a is provided with a fold line 30 which permits this sheet to fold during the piling up of the form sets 21. The uppermost form sheet 22 has a portion in excess which extends beyond a weak line 27 toward the next adjacent set and overlaps the head strip 24 thereof.

Figure 6:
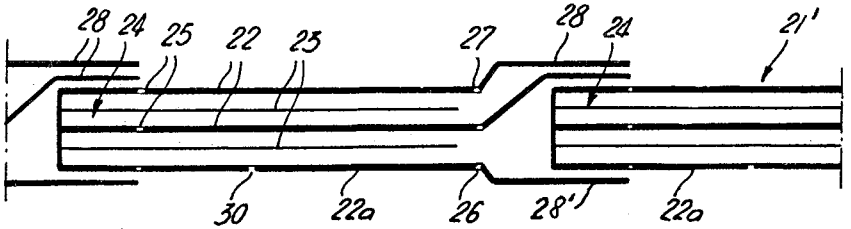
FIG. 6 is a view similar to FIG. 3 of another embodiment of the invention.

In the arrangement of FIG. 6, two uppermost forms 22 of each set are extended so that they overlap the head strip 24 of the next adjacent form set 21.

In all of the described examples, the form sets are directly connected to each other by their lowermost form sheets so that no special carrying web is needed and no waste results form the separation of the form sheets.

While specific embodiments of the invention have been shown and described in detail to illustrate the application of the principles of the invention, it will be understood that the invention may be embodied otherwise without departing from such principles.

What is claimed is:

1. A continuous train of carbon copy duplicating form sets for use in office machines comprising a continuous lowermost base sheet, a plurality of overlying sheet sets comprising longitudinally spaced vertical stacks of overlying sheets of the same kind and thickness as the base sheet which overlie said base sheet and are secured thereto at spaced locations along the length of said base sheet, each of said overlying sheets having a form imprinted on one face thereof and having a forward end and a rearward end, the uppermost one of said overlying sheets having an overlapping portion extending longitudinally in a rearward direction from said rearward end and overlying but not secured to the next adjacent overlying sheet set, said uppermost sheet with said overlapping portion being longer than the remaining overlying sheets of its associated stack, a first demarcation line extending across the widths of said overlying sheets and defining a head portion between said first demarcation line and said forward end, a second demarcation line extending across the widths of said uppermost sheet and defining an intermediate portion between said first and second demarcation line and defining said overhanging portion rearwardly of said uppermost sheet, said first and second demarcation lines also extending into said base sheet, fold lines extending across the width of said base sheet adjacent each intermediate portion, said sheets being separable along said first and second demarcation line, said continuous train being positionable in a vertical pile of said stacks with said form on each sheet facing the same direction.

2. A train of carbon copy duplicating form sets for use in office machines, according to claim 1, wherein the lowermost one of said sheets of all of said sets are interconnected, said interconnection comprising a weakened line between the sheets of adjacent sets permitting them to be severed along said line, and at least one further sheet of each of said sets having a forward head portion which overlaps the uppermost sheet of the next adjacent set.

3. A train of carbon copy duplicating form sets for use in office machines, according to claim 1, wherein said lowermost sheets are all interconnected and constitute an integral web in a single piece.

4. A train of carbon copy duplicating form sets for use in office machines, according to claim 1, wherein the uppermost one of each of said sheets of each of said sets include a forward head portion which engages over the uppermost sheet of the trailing head portion of the sheet of the next adjacent set.

* * * * *